US010208492B2

(12) United States Patent
Mayer et al.

(10) Patent No.: US 10,208,492 B2
(45) Date of Patent: Feb. 19, 2019

(54) CONSTRUCTION ANCHOR APPARATUS

(71) Applicant: Anchor Ring Solutions, LLC, Pen Argyl, PA (US)

(72) Inventors: Charles Mayer, Effort, PA (US); Michael J Tomack, Monroe, NJ (US); John P Marra, Jr., Bangor, PA (US); Joseph Fugallo, East Meadow, NY (US)

(73) Assignee: Anchor Ring Solutions, LLC, Pen Argyl, PA (US)

( * ) Notice: Subject to any disclaimer, the term of this patent is extended or adjusted under 35 U.S.C. 154(b) by 0 days.

(21) Appl. No.: 15/450,879

(22) Filed: Mar. 6, 2017

(65) Prior Publication Data

US 2018/0058062 A1 Mar. 1, 2018

Related U.S. Application Data

(60) Provisional application No. 62/440,711, filed on Dec. 30, 2016, provisional application No. 62/419,140, filed on Nov. 8, 2016, provisional application No. 62/398,944, filed on Sep. 23, 2016, provisional application No. 62/380,772, filed on Aug. 29, 2016.

(51) Int. Cl.

| | |
|---|---|
| ***E04G 21/32*** | (2006.01) |
| ***E04B 1/41*** | (2006.01) |
| *E04C 5/16* | (2006.01) |

(52) U.S. Cl.

CPC ..... *E04G 21/3276* (2013.01); *E04B 1/4142* (2013.01); *E04B 2001/4192* (2013.01); *E04C 5/162* (2013.01)

(58) Field of Classification Search

CPC ..... E04B 1/4107; E04B 2001/4192; E04C 5/162; E04C 5/12

USPC ..... 52/125.4, 124.2, 125.5, 702, 704, 707, 52/710

See application file for complete search history.

(56) References Cited

U.S. PATENT DOCUMENTS 1,700,889 A * 2/1929 Heltzel ..... E01C 23/021 249/4
2,031,901 A * 2/1936 Mitchell ..... E01C 23/045 404/88
2,079,123 A * 5/1937 Lind ..... E01C 11/14 404/62
2,095,060 A * 10/1937 Geyer ..... E01C 11/14 404/60

(Continued)

FOREIGN PATENT DOCUMENTS

EP 2743426 A1 6/2014

OTHER PUBLICATIONS

International Search Report dated Nov. 21, 2017 issued in corresponding PCT Appln. No. PCT/US17/49086.

*Primary Examiner* — Joshua K Ihezie
(74) *Attorney, Agent, or Firm* — Ryan, Mason & Lewis, LLP

(57) ABSTRACT

A construction anchor apparatus has utility as a safety grip for engagement by construction personnel, and, in addition, a support apparatus for supporting and/or holding construction equipment including ductwork, electrical cables, plumbing, etc. The anchor apparatus is used in conjunction with rebar applied in concrete support walls, floors, ceilings, or other structural elements at a construction site.

18 Claims, 15 Drawing Sheets

(56) References Cited

U.S. PATENT DOCUMENTS 2,265,301 A * 12/1941 Meyer ..... E01C 11/02 404/47
2,277,449 A * 3/1942 Paine ..... E04B 1/415 52/706
2,636,426 A * 4/1953 Heltzel ..... E01C 11/14 249/9
3,550,343 A * 12/1970 Buske ..... E04B 1/4142 410/112
3,599,379 A * 8/1971 Tuska ..... E04B 1/4157 248/506
3,705,469 A * 12/1972 Eriksson ..... B28B 23/005 249/66.1
4,000,591 A * 1/1977 Courtois ..... B28B 23/005 52/125.4
4,437,642 A * 3/1984 Holt ..... B66C 1/66 249/175
4,580,378 A * 4/1986 Kelly ..... E04G 21/142 52/125.4
4,648,739 A * 3/1987 Thomsen ..... E01C 11/227 404/2
4,945,704 A * 8/1990 Brown, Jr. ..... E04C 5/168 52/699
5,226,265 A * 7/1993 Kelly ..... E04G 21/142 294/82.35
5,623,804 A * 4/1997 Kelly ..... E04B 1/4107 52/704
5,625,993 A * 5/1997 Kelly ..... E04B 1/4107 52/506.05
6,092,849 A * 7/2000 Zambelli ..... E04G 21/142 294/82.1
6,550,834 B2 * 4/2003 Fromelius ..... B66C 1/666 294/89
6,598,364 B1 * 7/2003 Pelles ..... E01C 11/126 404/47
6,688,049 B2 * 2/2004 Sanftleben ..... E04G 15/04 294/89
7,137,609 B2 * 11/2006 Sack ..... B29C 45/14073 249/91
8,024,896 B2 * 9/2011 Azarin ..... B28B 23/005 52/125.1
8,413,400 B2 * 4/2013 Mackay Sim ..... B28B 7/002 249/96
8,806,836 B2 * 8/2014 James ..... E04B 1/4157 403/364
9,127,415 B1 * 9/2015 Blackwell ..... E04G 15/04
9,359,779 B2 * 6/2016 Borchardt ..... E04G 21/3295
2002/0062604 A1 * 5/2002 Fromelius ..... B66C 1/666 52/125.5
2004/0136785 A1 * 7/2004 Gunter ..... E01C 11/227 405/118
2007/0039281 A1 * 2/2007 Zambelli ..... E04B 1/4107 52/710
2010/0000175 A1 * 1/2010 Johnson ..... B28B 23/0056 52/704
2011/0108319 A1 * 5/2011 Gauthier ..... H02G 3/121 174/520
2011/0265296 A1 11/2011 Perkins
2015/0196782 A1 7/2015 Akagane
2015/0367152 A1 * 12/2015 Borchardt ..... A62B 35/0068 248/324
2016/0096047 A1 4/2016 Sailer
2016/0168849 A1 * 6/2016 Ryan ..... E04B 2/8641 52/404.2

* cited by examiner

CONSTRUCTION ANCHOR APPARATUS

BACKGROUND

Technical Field

The present disclosure relates to a construction apparatus, and, in particular, relates to an anchor apparatus adapted to function as a safety grip for construction personnel and/or for supporting construction equipment such as ductwork, electrical cables, plumbing etc. within a construction site.

Background of Related Art

Construction sites require grip or strap devices to ensure the safety of the construction personnel operating at the site. A conventional grip device may include a strap which is secured to a wall, beam or the like through a fastener and placed at various locations within the construction site such that upon moving through the site, the construction personnel may engage one of the devices at a select location. However, such known grip devices present a number of obstacles, which detract from their usefulness. Firstly, application of the grip device requires additional tasks to secure the device to the structural element. Secondly, the integrity of the grip device is dependent on the fastener utilized and its application, which, in many instances, is insufficient to adequately support construction personnel. Furthermore, current grip devices only have a single utility as a safety grip and cannot be used in conjunction with other tasks to be performed at the construction site.

SUMMARY

Accordingly, the present disclosure is directed to a construction anchor apparatus having utility as a safety grip for engagement by construction personnel, and, in addition, a support apparatus for supporting and/or holding construction equipment including ductwork, electrical cables, plumbing, etc. The anchor apparatus is used in conjunction with rebar applied in concrete support walls, floors, ceilings, or other structural elements at a construction site. In one embodiment, an anchor apparatus includes a main module having opposed walls defining a longitudinal axis and an internal chamber with the opposed walls each defining an elongated opening in communication with the internal chamber, a module mount associated with each of the opposed walls and a rebar mount coupled to each module mount. The rebar mounts each define an aperture therethrough. Each rebar mount is configured for reciprocal longitudinal movement within the module mount to generally align the apertures of the rebar mount with the elongated openings of the main module to permit reception and passage of a length of rebar.

In embodiments, the elongated openings of the main module are configured to permit traversing movement of the length of rebar while the rebar mounts move within the module mount. In some embodiments, the rebar mounts each include a pair of longitudinal spaced rails with each rail defining a groove for reception of an edge of the rebar mount.

In certain embodiments, an end cap is mountable to the main module to enclose the internal chamber. The end cap may include a pair of external rails and the main module may include a pair of internal grooves for reception of the external rails to facilitate mounting of the end cap relative to the main module.

In embodiments, a support assembly is mountable relative to the main module and couplable to the length of rebar within the main module. The support assembly is configured to support one of construction personnel or construction equipment. In some embodiments, the support assembly includes a coupling member configured for coupling with the length of rebar within the main module and an elongate support member extending from the coupling member.

In another aspect, a method of construction is disclosed. The method includes positioning an anchor apparatus at a predetermined location within a construction site, securing a main module of the anchor apparatus at the predetermined location, passing rebar through openings in opposed walls of the main module, and securing a support assembly to a length of rebar extending through the main module whereby the support assembly is configured for supporting one of construction personnel or construction equipment.

The method may include utilizing the support assembly to facilitate maneuvering of the construction personnel about the construction site or to support construction equipment. In embodiments, the main module includes a rebar mount disposed on each wall of the opposed walls and wherein passing the rebar includes aligning rebar receiving apertures of the rebar mounts with the openings in the opposed walls of the main modules and passing the length of rebar through the apertures of the rebar mounts and the openings of the opposed walls.

In some embodiments, the rebar mounts are configured for reciprocal longitudinal movement relative to a longitudinal axis of the main module and wherein passing the rebar includes moving the rebar mounts along the longitudinal axis such that the rebar receiving apertures of the rebar mounts are aligned with the length of rebar for reception thereof. In certain embodiments, the openings in the opposed walls of the main module are elongated along the longitudinal axis whereby during, moving the rebar mounts, the rebar receiving apertures are continuously in alignment with the openings in the opposed walls.

In embodiments, the method includes depositing cement within the main module whereby the main module becomes at least partially embedded within one of a structural element of the construction site.

Other advantages of the construction anchor apparatus will be appreciated from the following description.

BRIEF DESCRIPTION OF THE DRAWINGS

Various aspects and features of the present disclosure are described hereinbelow with references to the drawings, wherein.

DETAILED DESCRIPTION

Particular embodiments of the present disclosure are described hereinbelow with reference to the accompanying drawings. However, it is to be understood that the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to employ the present disclosure in virtually any appropriately detailed structure.

Figure 1:
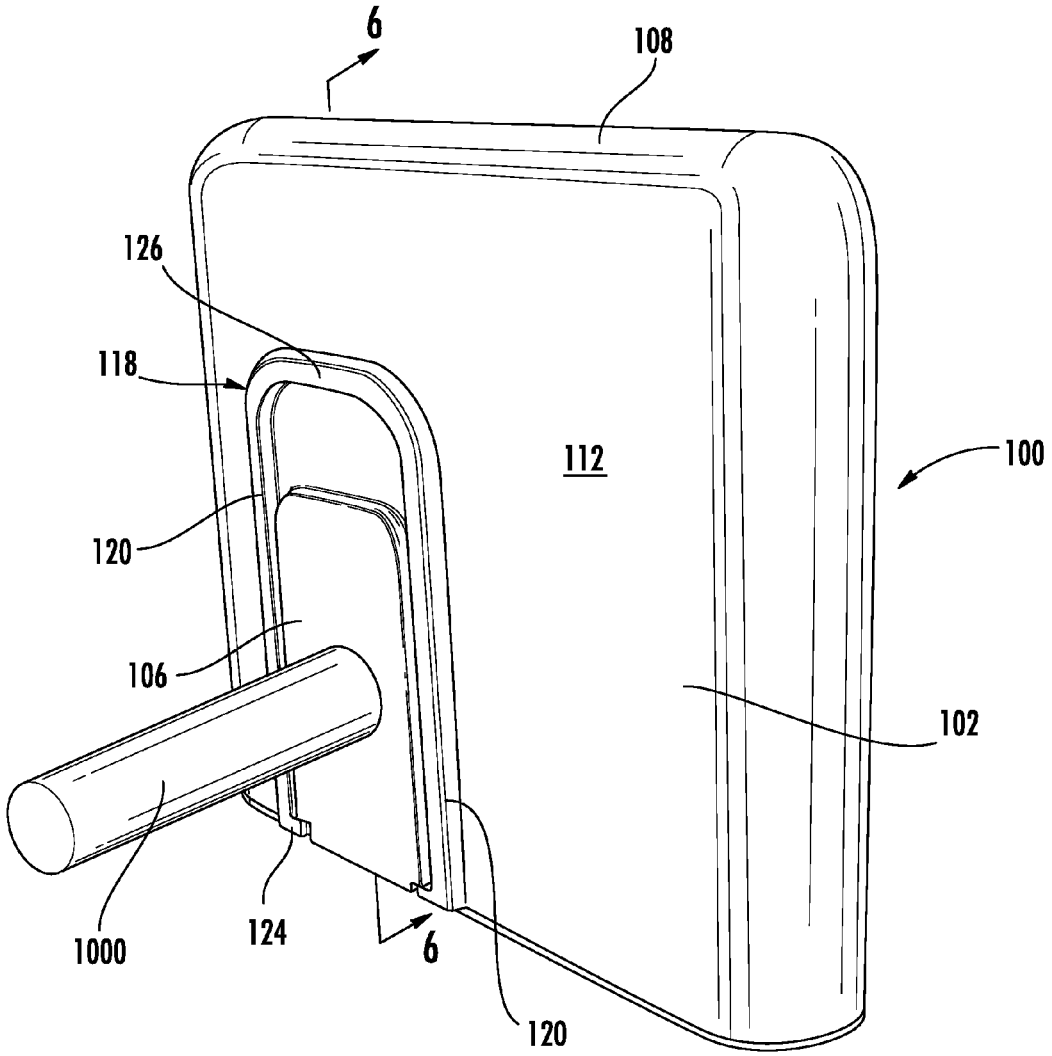
FIG. 1 is a perspective view of the construction anchor apparatus in accordance with the principles of the present disclosure illustrating the main module, the end cap mounted to the main module and the pair of rebar mounts coupled to the main module, and further illustrating a length of rebar coupled relative to the rebar mounts.

Referring now to FIG. 1, there is illustrated the construction anchor apparatus in accordance with the principles of the present disclosure. In FIG. 1, the anchor apparatus 100 is depicted supporting a length of rebar 1000 which may be engaged by a support assembly for safety purposes for construction personnel and/or for supporting and/or holding construction equipment such as ductwork, electrical cables, plumbing materials or the like.

Figure 2:
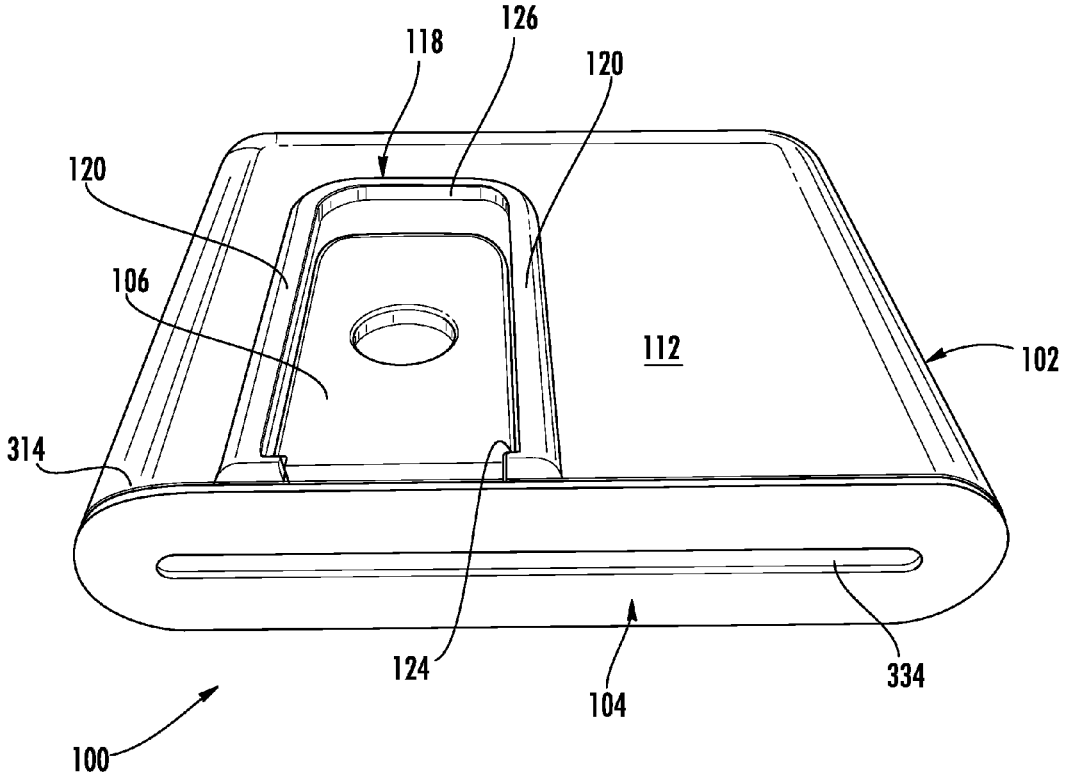
FIG. 2 is a frontal perspective view of the anchor apparatus.
Figure 3:
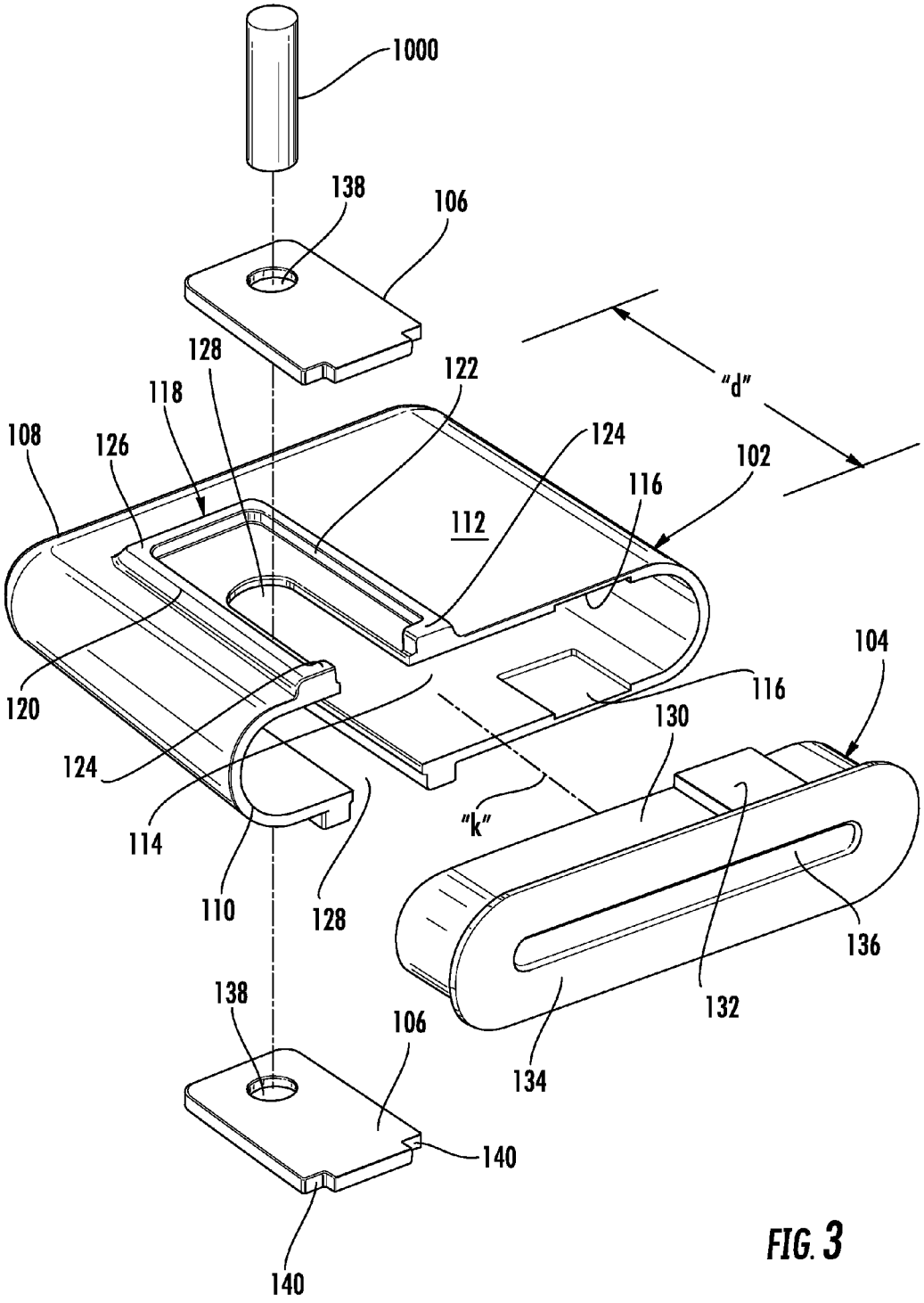
FIG. 3 is an exploded perspective view of the anchor apparatus.

With reference now to FIGS. 1-3, the anchor apparatus 100 includes a main module 102 defining a longitudinal axis "k", an end cap 104 mountable to the main module 102 and a pair of rebar mounts 106. The main module 102 may be generally rectangular or square-shaped to define a box having a closed end 108, an open end 110 adjacent the end cap 104 and opposed walls 112 to which the rebar mounts 106 are coupled. The main module 102 defines an internal chamber 114 through which the rebar 1000 passes. The internal chamber 114 also may receive concrete at the end of construction. In embodiments, the dimensioning of the main module 102 corresponds to the mold work utilized to eventually form the support column, support wall, ceiling, floor or other construction element to be constructed within the site. For example, the depth "d" of the main module 102 may be equal to the depth of the mold work used in forming a column of a support wall, ceiling or floor in which the module 102 will be positioned. Although shown as generally rectangular, the main module 102 may assume other shapes such as circular or other polygonal configurations.

Figure 4:
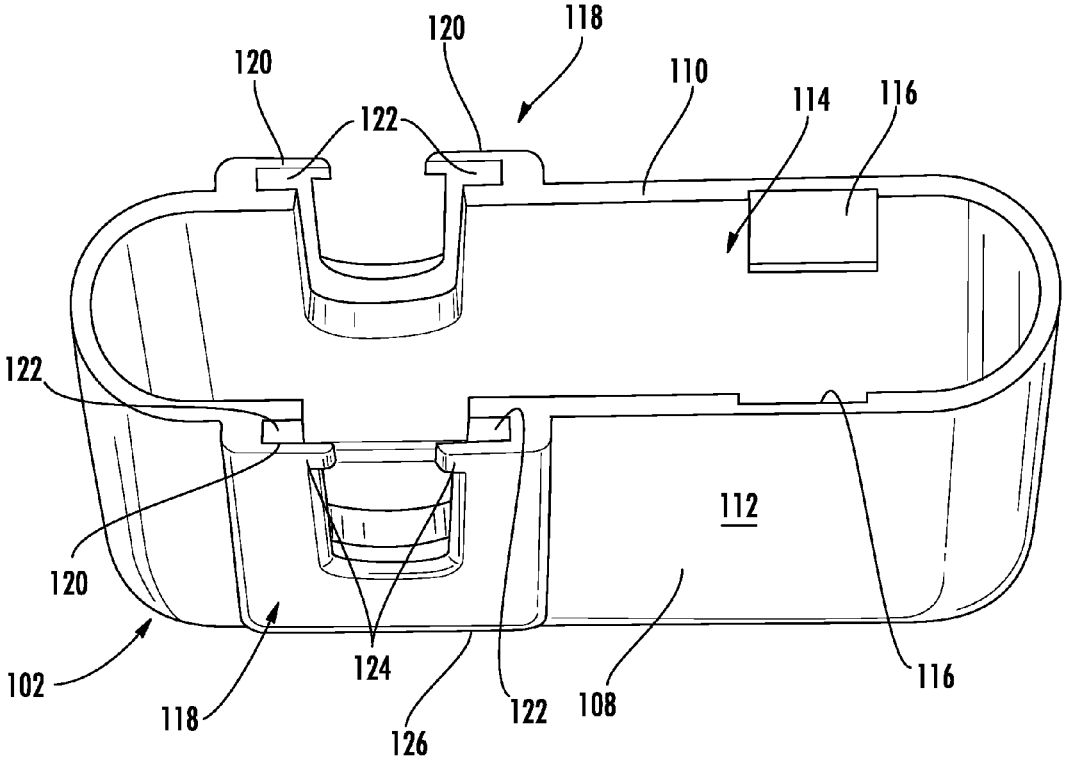
FIG. 4 is a perspective view of the main module of the anchor apparatus.

With reference to FIGS. 3-4, the main module 102 may include a pair of diametrically opposed internal grooves 116 defined within the opposed walls 112. The grooves 116 assist in mounting the end cap 104. In other embodiments, the main module 102 may be devoid of internal grooves 116. The main module 102 further includes a pair of module mounts 118 on the exterior of the opposed walls 112 of the main module 102, which receive respective rebar mounts 106 in the assembled condition of the anchor apparatus 100. The module mounts 118 each include opposed rails 120 with each rail 120 defining an internal groove 122 to accommodate an edge of a respective rebar mount 106. In embodiments, the internal grooves 122 of each rail 120 may taper to define a height adjacent the open end 110 of the main module 102 which is less than the height of the internal groove 122 adjacent the closed end 108 of the main module 102. In other embodiments, the internal grooves 122 define a constant height along their respective lengths.

The module mounts 118 may further include a pair of module stops 124 adjacent the open end 110 of the main module 102 and a module wall 126 adjacent the closed end 108 of the main module 102. The module stops 124 and the module wall 126 cooperate to prevent release of the rebar mount 106 from the main module 102. The main module 102 further includes opposed elongated openings 128 in the opposed walls 112 and positioned within the module mounts 118. The elongated openings 128 may be coterminous with the open end 110 of the main module 102 or may extend short of the open end 110. The elongated openings 128 accommodate the rebar 1000 during traversing longitudinal movement of the rebar mounts 106.

With reference to FIGS. 3, 4, 6 and 7, the end cap 104 is configured for mounting to the open end 110 of the main module 102. In an embodiment, the end cap 104 includes an outer cap wall 130 dimensioned to be received within the open end 110 to establish a frictional relation therewith. The outer cap wall 130 may be capable of traversing movement within the open end 110 of the main module 102 to permit selective positioning of the end cap 104 relative to the main module 102 to accommodate variations in dimensioning of the structural element, e.g. a vertical wall, horizontal floor or ceiling to which the construction apparatus is mounted. The end cap 104 may include rails 132 which are received within the correspondingly dimensioned grooves 116 within the interior of the main module 102 to facilitate alignment and traversing movement of the end cap 104. In the alternative, the end cap 104 may be devoid of the rails 132. The end cap 104 includes a cap end 134 defining a recess 136 (FIG. 3) in its exterior surface, which facilitates removal of the end cap 104 during use.

Figure 5:
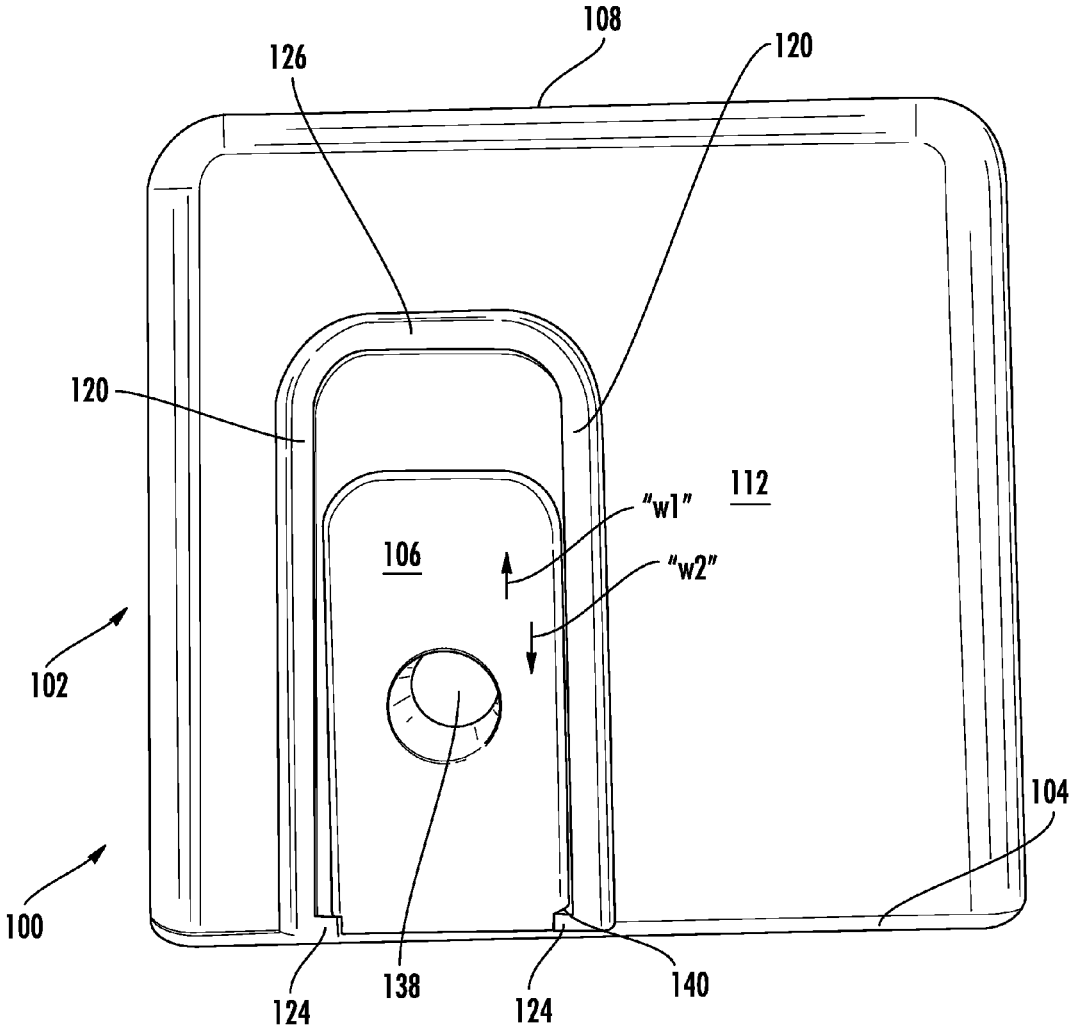
FIG. 5 is a side plan view of the anchor apparatus.
Figure 6:
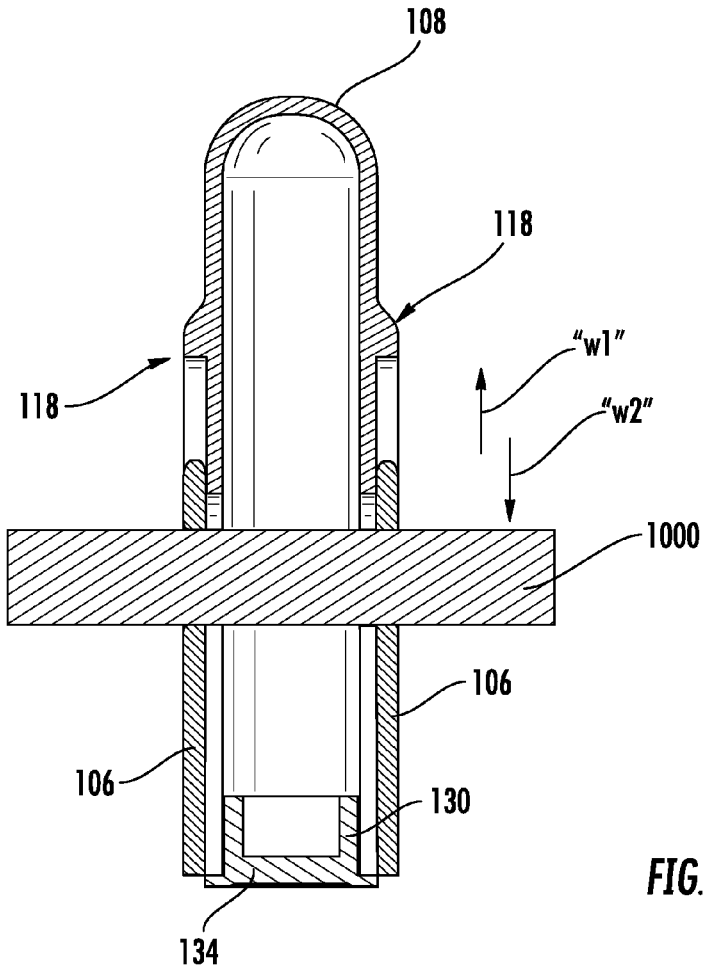
FIG. 6 is a cross-sectional view of the anchor apparatus taken along the lines 6-6 of FIG. 1.
Figure 7:
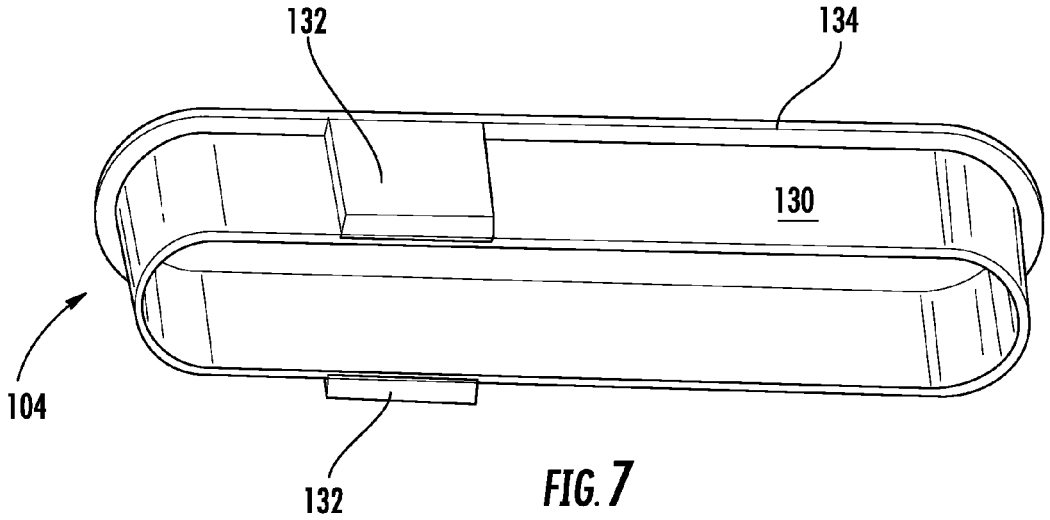
FIG. 7 is a perspective view of the end cap of the anchor apparatus.

With reference again to FIGS. 3-5, the rebar mounts 106 are generally rectangular in shape to generally correspond to the configuration of the module mounts 118. Each rebar mount 106 includes an aperture 138 therethrough for reception and passage of the rebar 100. As best depicted in FIGS. 5-6, the rebar mounts 106 may traverse or reciprocally move within the module mounts 118 in the direction of directional arrows "w1", "w2" (e.g., along the longitudinal axis "k") to facilitate alignment of the apertures 138 of the rebar mounts 106 with the rebar 1000 and/or permit movement of the rebar 1000 subsequent to mounting of the anchor apparatus 100 to the structural element. The apertures 138 of the rebar mounts 106 are in alignment with the elongated openings 128 in the opposed walls 112 whereby the length of rebar 1000 slides within the elongated openings 128 during traversing movement of the rebar mounts 106. The rebar mounts 106 also include rebar edges or stops 140 which contact the module stops 124 to prevent release of the rebar mounts 106 from the module mounts 118.

The use of the anchor apparatus 100 at a construction site will now be described. A plurality of anchor apparatuses 100 are positioned at various predetermined locations within the construction site to eventually serve as safety grips for construction personnel or supports for construction equipment. In embodiments, these locations are coincident with walls, ceilings, floors, columns or other structural element. Each anchor apparatus 100 may be temporarily secured at the select position with tie rods or the like. Thereafter, rebar 1000 is passed through the main module 102 by introducing the rebar 1000 through the apertures 138 of the rebar mounts 106. As noted hereinabove, the rebar mounts 106 may reciprocally move within the module mounts 118 such that the apertures 138 are aligned with the passing rebar 1000 to permit passage through the elongated openings 128 of the main module 102 and through the main module 102.

Figure 8:
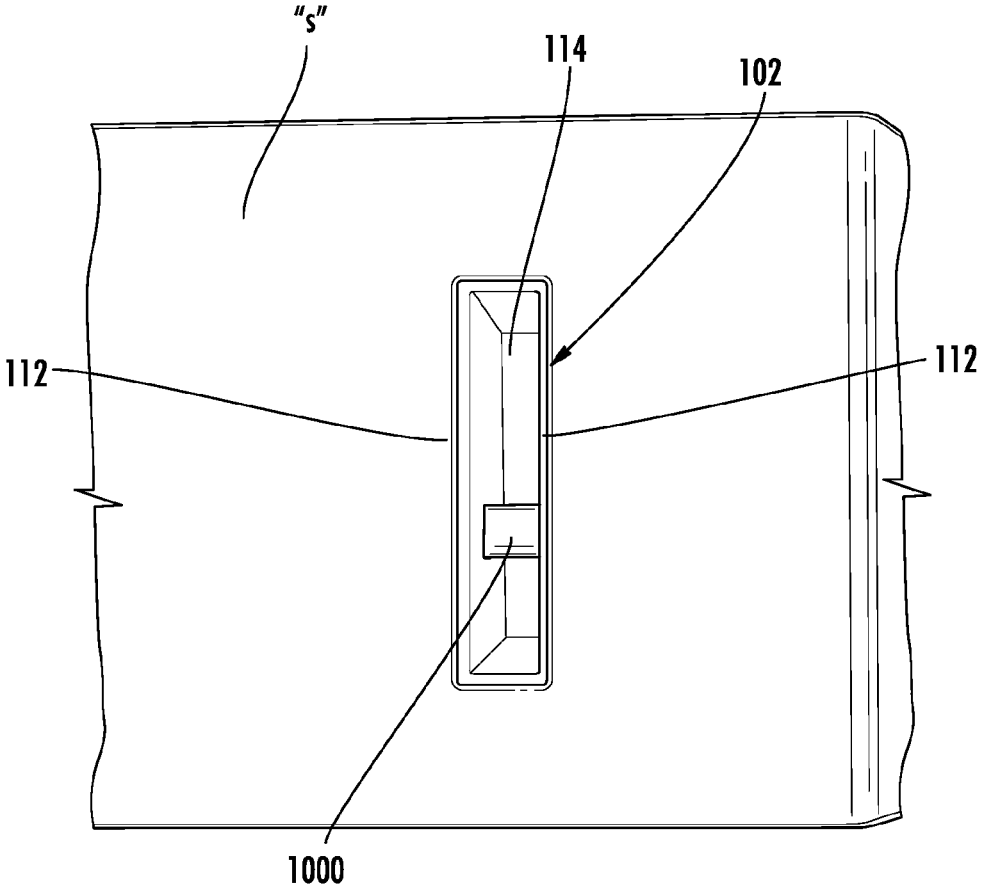
FIG. 8 is a view illustrating the anchor apparatus mounted to a structural element with a length of rebar coupled to the anchor apparatus.

Thereafter, with reference to FIG. 8, concrete may be poured to form the structural element "s", i.e., the column, floor, wall etc. with the anchor apparatus 100 mounted therewithin. The concrete cures and the anchor apparatus 100 is secured relative to the structural element "s". The end cap 104 may be removed as shown through, e.g., engagement of a removal tool, e.g., a flat head screwdriver, with the recess 136 of the end cap 104 to expose the rebar 1000 within the internal chamber 114 of the main module 102.

Figure 9:
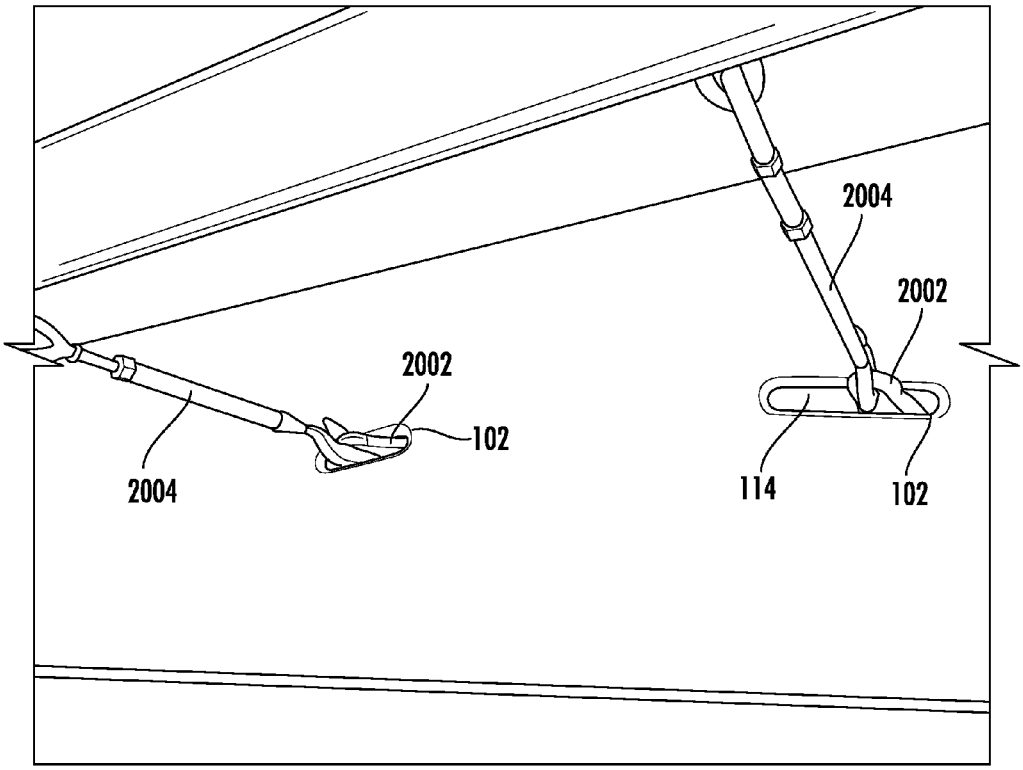
FIG. 9 is a view of use of the apparatus in securing a support assembly at a construction site.
Figure 10:
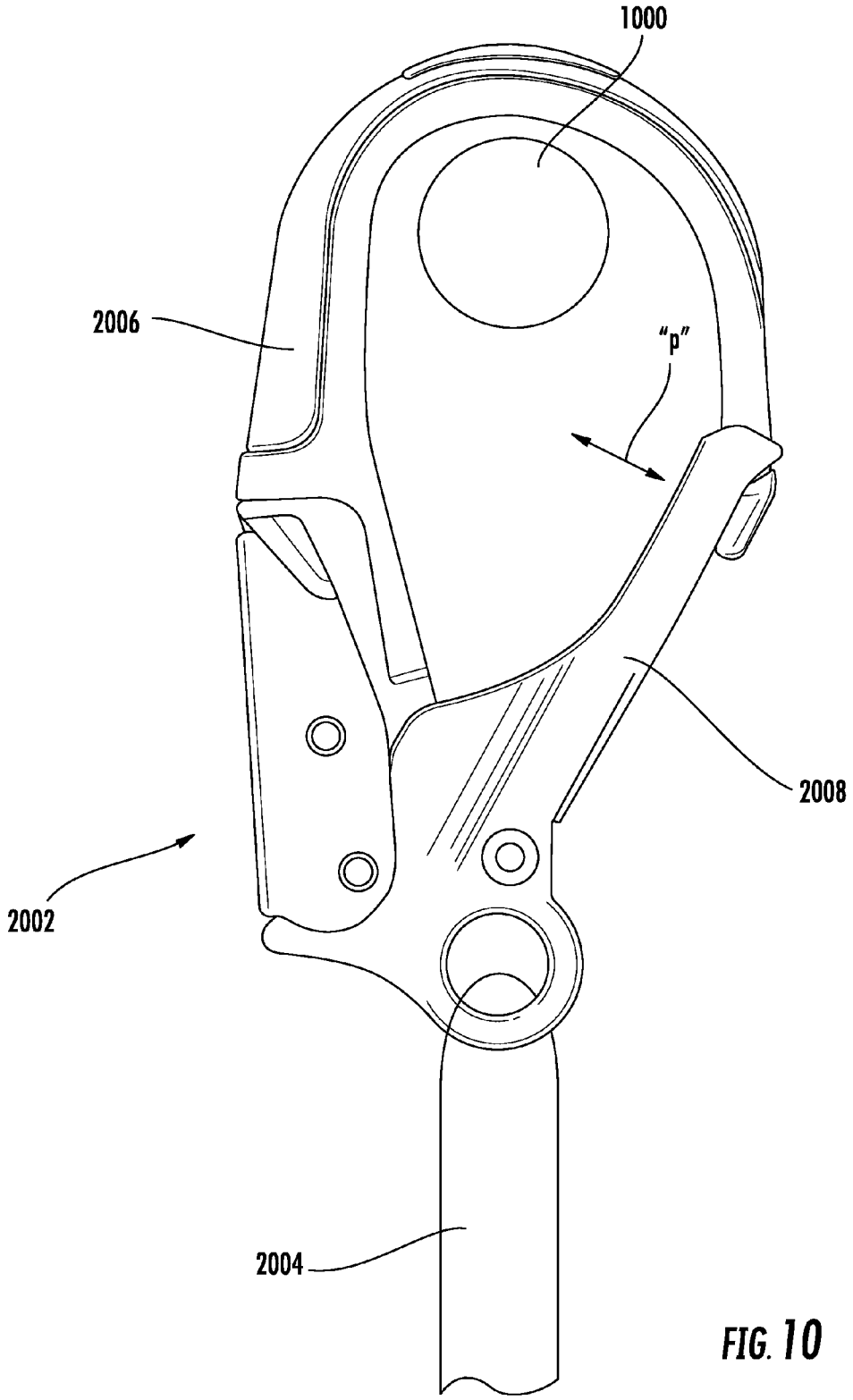
FIG. 10 is a view of a snap hook of the support assembly engaging the length of rebar within the main module of the anchor apparatus.

Referring now FIG. 9, a support assembly 2000 including a coupling member such as a snap hook 2002 and a support bar or strap 2004 is secured about the rebar 1000. In general, the snap hook 2002 is introduced within the open end 110 of the main module 102 and into the internal chamber 114 (with the end cap 104 removed). The snap hook 2002 is and snapped and locked about the rebar 1000. The support bar or strap 2004 may be secured to each snap hook 2002 either before or subsequent to placement of the snap hook 2002 about the rebar 1000. FIG. 10 illustrates the snap hook 2002 secured about the rebar 1000 within the main module 102. One suitable snap hook 2002 includes a main body 2006 and a lock 2008 pivotally mounted to the main body 2006 and adapted to pivot in the direction of directional arrow "p" between an open position (not shown) and a closed position as shown.

With a plurality of anchor apparatuses 100 and associated support mechanisms 2000 coupled thereto in select positions about the construction site, construction personnel may traverse the construction site, through engagement with the support assemblies 2000. Alternatively, the support assemblies 2000 may be used to support construction material, lines, ductwork, wires etc. It is to be appreciated that the movability of the rebar mounts 106 relative to the main modules 102 will accommodate shifting movement of construction material. For example, if the construction site is subjected to an event either natural or man-made, e.g., an earthquake or the like, which may potentially displace the construction material, the rebar mounts 106 will traverse the module mounts 108 to accommodate any displacing movement, either lateral, vertical or horizontal, of the construction material thereby preserving the integrity of the unit.

Once it is determined the anchor apparatuses 100 are no longer needed, e.g., upon completion of a construction phase, the support assemblies 2000 may be removed from the rebar 1000 and their respective anchor apparatuses 100. In embodiments, the main module 102 of each anchor apparatus 100 may be filled with concrete to close the internal chambers 114. Thus, the anchor apparatuses 100 may be permanently embedded in the structural element, e.g., including the walls, columns, floors of the building, and do not require removal. In other embodiments, the main module 102 is left unfilled.

Figure 11:
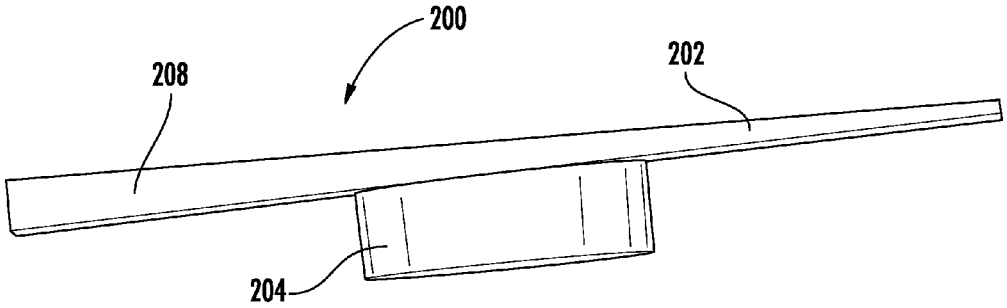
FIGS. 11-12 are side and top plan views of an alternate rebar mount of the anchor apparatus.
Figure 12:
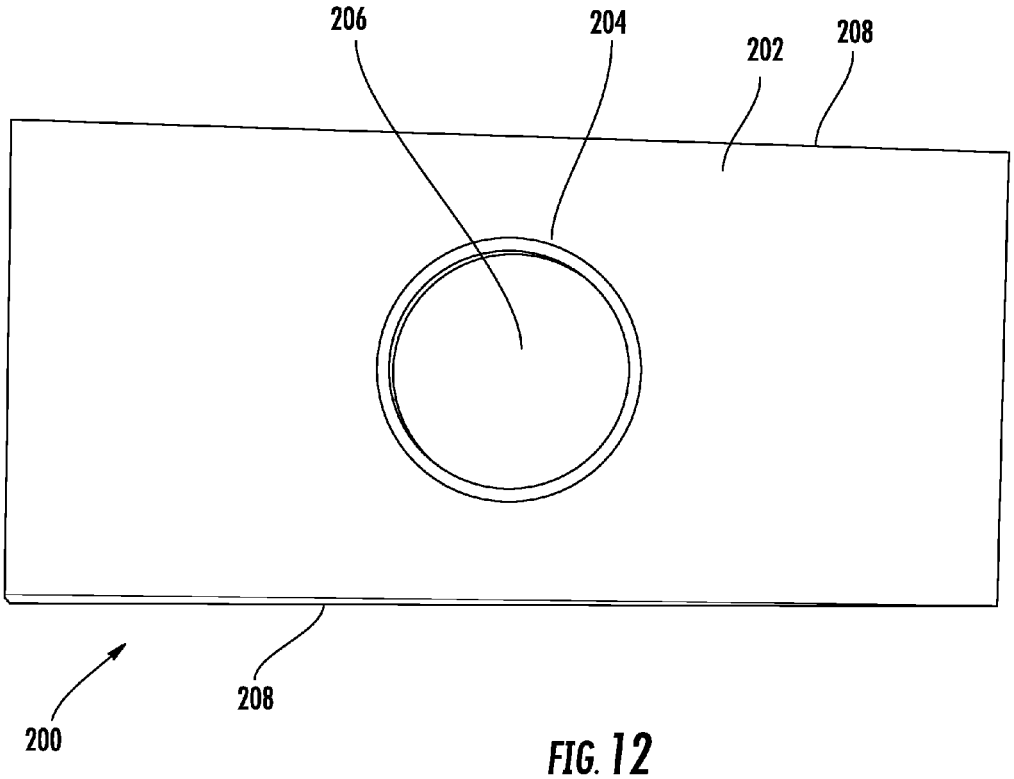

FIGS. 11-12 illustrate an alternate embodiment of the rebar mount for use with the anchor apparatus 100. The rebar mounts 200 each include a base plate 202 and a cylindrical receptacle 204 depending from the base plate 202. The cylindrical receptacle 204 each defines an aperture 206 therethrough for reception and passage of the rebar 1000. The base plate 202 defines edges 208 which are received within the internal grooves 122 of the rails 120 of the module mounts 118 to couple the rebar mounts 200 with the main module 102. The base plate 202 may be formed of a resilient material whereby the edges 208 may be deformed to snap fit within the internal grooves 122 of the rails 120 during assembly. The base plates 202 each may define a tapered arrangement whereby the thickness of the base plate 202 tapers from the end adjacent the end cap 104 toward the end adjacent the closed end 108 of the main module 102. This thickness or taper may correspond to any corresponding taper of the internal grooves 122 of the module mounts 118 as discussed hereinabove. The tapered arrangement may facilitate securement of the rebar mount 200 at selected positions relative to the module mount 118 (e.g., through creation of a morse taper relation). In addition, the tapered arrangement may correspond to a taper of the opposed walls 112 of the main module 102. It is envisioned that during manufacture of the main module, the opposed walls 112 may be arranged at a slight oblique angle relative to the longitudinal axis "k" of the main module 102 such that the opposed walls 112 taper inwardly toward the closed end 108 of the main module 102. The angle may range from about 80 degrees to about 89 degrees. The respective tapers ensure that the cylindrical receptacles 204 are aligned to receive the rebar 1000.

The base plates 202 of the rebar mounts 200 move within the internal grooves 122 of the main module 102 in the manner described hereinabove to align the cylindrical receptacles 204 and permit passage of the rebar 1000 through its apertures 206.

Figure 13:
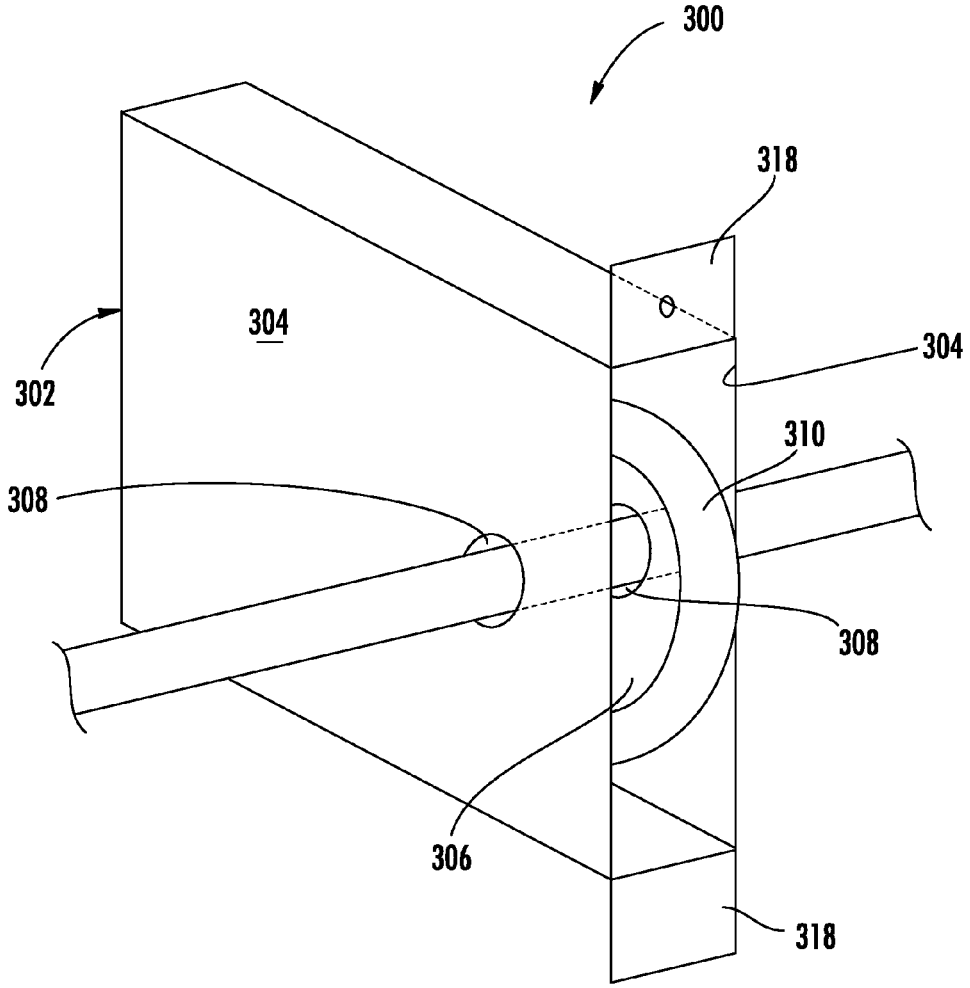
FIG. 13 is a perspective view of one embodiment of the anchor apparatus.
Figure 14:
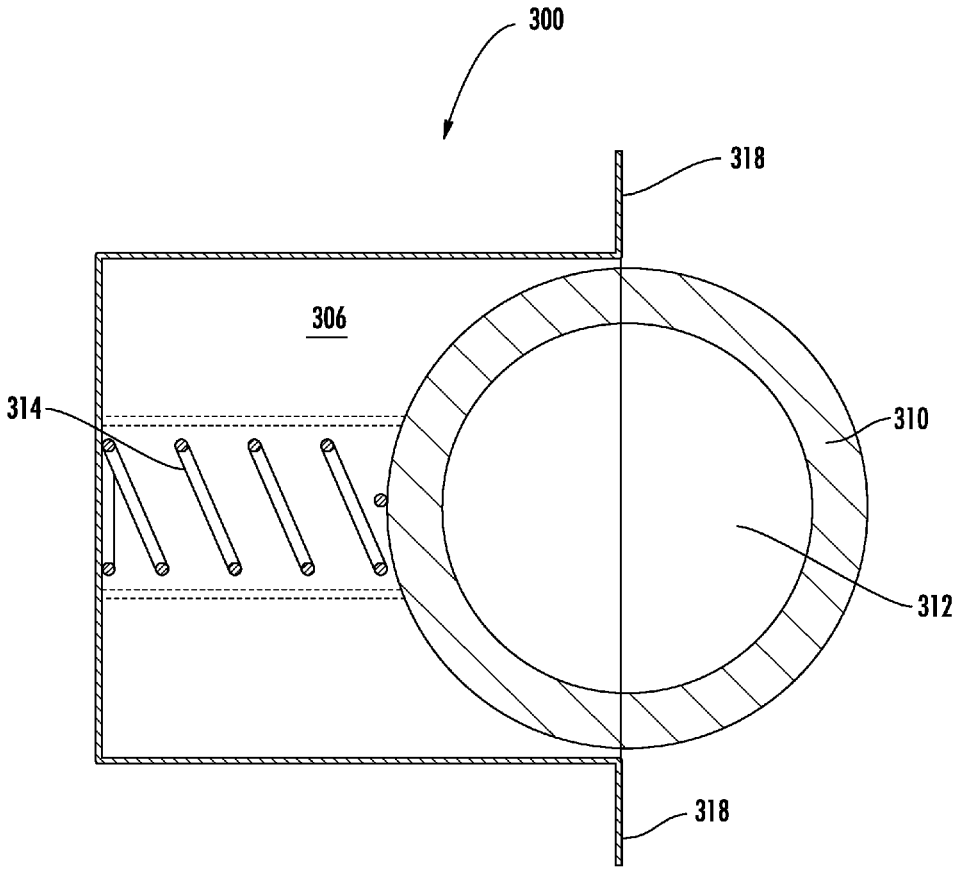
FIG. 14 is a side cross-sectional view of the anchor apparatus of FIG. 13.

FIGS. 13-14 illustrate an alternate embodiment of the present disclosure. Anchor apparatus 300 includes a main module 302 defining a general box-like configuration and having opposed walls 304 and defining an internal chamber 306. Each opposed wall 304 defines an opening 308, which are in general alignment and configured to receive a length of rebar 1000, extending through the main module 302. The openings 308 may be circular and may generally correspond in diameter to the diameter of the rebar 1000. An anchor ring 310 is mounted within the main module 302 and defines a ring opening 312 for reception of the rebar. The anchor ring 310 may be various shapes including circular, oval square, D-shaped etc. In embodiments, a spring 314 or other type of resilient member is secured within the main module 302 and is coupled to the ring 310 to bias the anchor ring 310 outwardly through the front opening 316 in the main module 302. The spring 314 may be secured to both the main module 302 and the anchor ring 310 through conventional methodologies including welding, brazing, adhesives or the like. The main module 302 may also includes opposed flanges 318, which assist in securing the main module 302 to the framing of the structural element.

In application at a construction site, a plurality of anchor apparatuses 300 are positioned at various predetermined locations and secured within the construction site in the aforedescribed manner. The opposed flanges 318 may be utilized by, e.g., driving a fastener through the flanges 318 and into structural element. Rebar 1000 is ran or mounted within the intended structural element, e.g. a vertical wall, horizontal floor or ceiling prior to formation of same and passed through the openings 308 of the main module and through the ring opening 312 of the ring 310. The rebar 1000, which is fixed and secured within the moldwork, thus secures each anchor apparatus 300 and anchor ring 310 therewithin. Accordingly, as construction personnel traverse the construction site, they may grab the anchor rings 310 or any strap assembly coupled thereto with confidence that the anchor apparatus 300 is positively fixed within the site. The bias of the anchor ring 310 outwardly facilitates engagement by the construction personnel. In addition, the anchor rings 310 may support construction material including, but, not limited to, electrical cables, ductwork, plumbing etc. Thus, during the construction phase, the construction material is supported by the main modules 302 with spring biased anchor rings 310. Any undesired movement of the construction material during construction (when subjected to an event described hereinabove) is accommodated by the spring 314 and the anchor ring 310.

When it is determined that the support wall, ceiling or floor is to be poured or built within the moldwork cement or concrete, the concrete is poured within the framing forming the wall, and the anchor apparatus 100 becomes embedded within the structural element. In embodiments, the concrete may be deposited through, e.g., the front opening 316, and the chamber 306 of the main module 302 is filled with cement. Thus, removal of the main module 302 is not required prior to pouring cement. Upon curing of the cement, the anchor ring 310, which extends from the main module 302 and the poured support wall, may be removed via cutting with a saw or the like.

Figure 15:
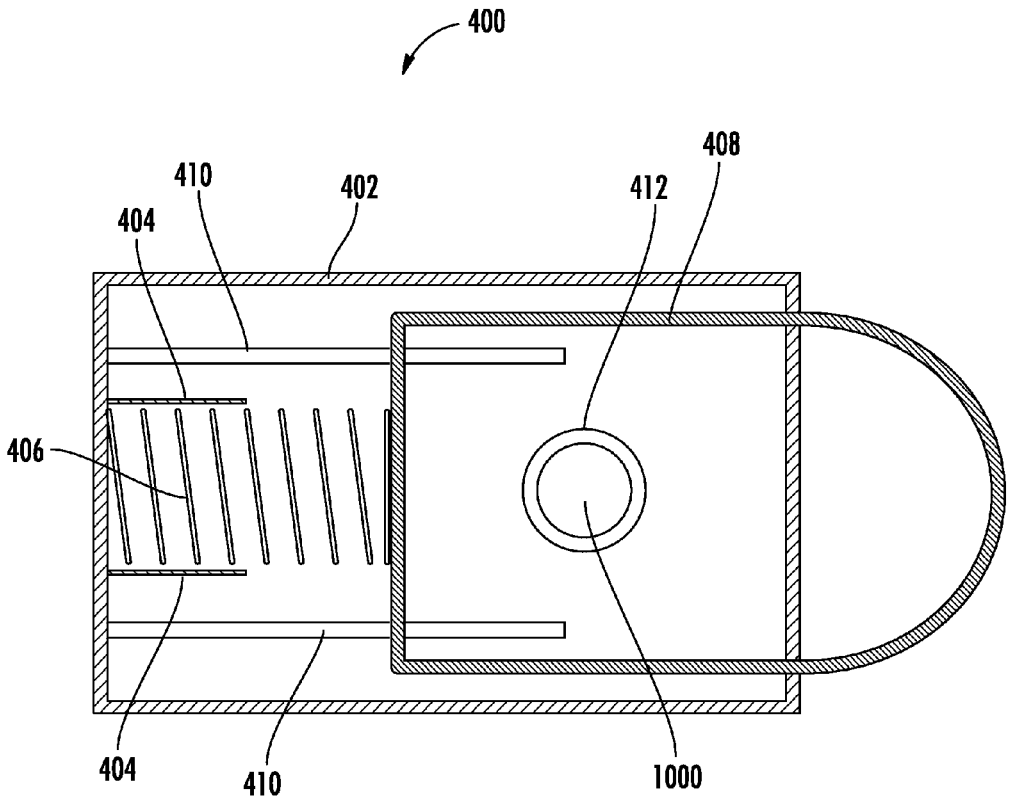
FIG. 15 is a side cross-sectional view of one embodiment of the anchor apparatus.
Figure 16A:
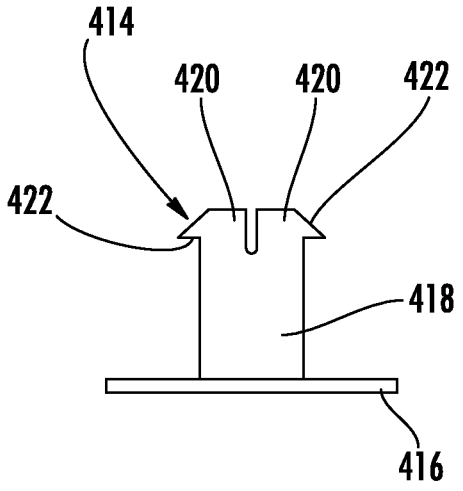
FIGS. 16A-16B are side and top plan views of a plug utilized with the anchor apparatus of FIG. 15.
Figure 16B:
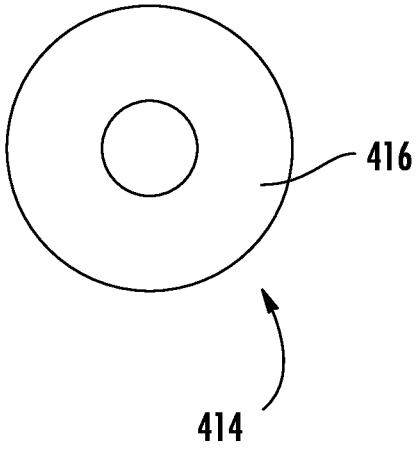
Figure 17:
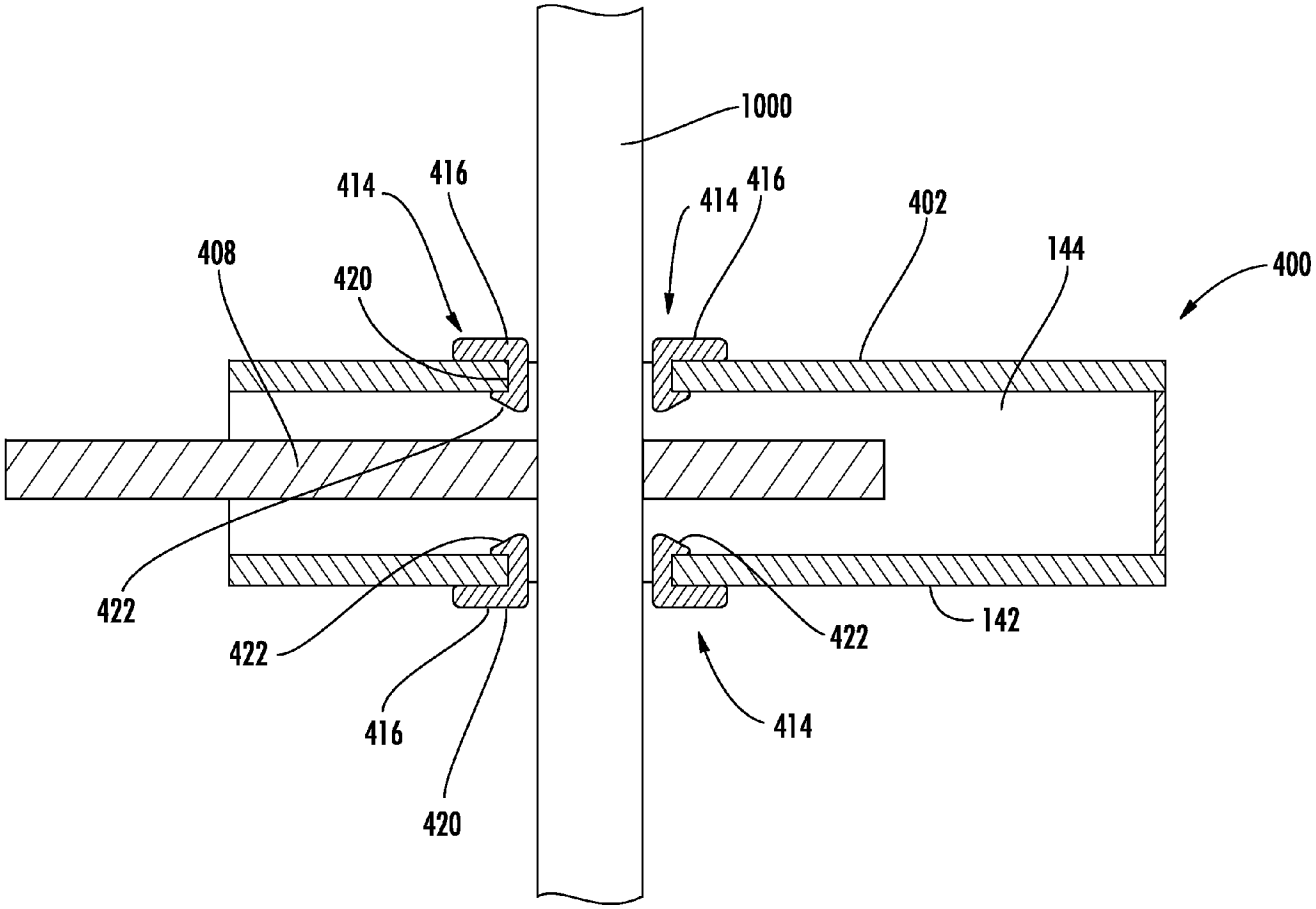
FIG. 17 is a cross-sectional view illustrating a length of rebar passing through the plugs and the main module of the anchor apparatus of FIG. 15.

FIGS. 15-17 illustrate another embodiment of the construction anchor apparatus in accordance with the principles of the present disclosure. The construction apparatus 400 is similar to the apparatus 300 of FIGS. 13-14, and includes a main module 402 having two internal walls 404 arranged in spaced relation. The internal walls 404 receive and/or accommodate a coil spring 406 restricting lateral movement of the coil spring 406 while permitting the coil spring 406 to expand and contract in the aforedescribed manner. A generally D-shaped anchor ring 408 is secured to the coil spring 406 for serving as safety grips for construction personnel or supports for construction equipment such as plumbing, electrical lines, ductwork etc. The D-shaped anchor ring 408 may be guided for traversing movement by internal rails 410 within the main module 402 on each side of the main module 402. An opening 412 extends through opposed walls of the module 102 for reception of a section of rebar 1000.

As best depicted in FIGS. 16-17, the construction apparatus 400 further includes a pair of rebar support elements 414 (not shown in FIG. 15) which are mounted within the openings 412. The rebar support element 414 may include a flange 416, a plug 418 extending from the flange 416 and a plurality of resilient mounting legs 420 extending from the plug 418. The rebar support element 414 is made in whole or in part of an elastomeric or resilient member such as rubber, gel foam, etc. To mount the rebar support element 414, the mounting legs 420 and the plug 418 are inserted within the openings 412. During insertion, the mounting legs 420 flex inwardly to permit passage through the openings 412 whereby upon clearing the openings 412, the mounting legs 420 return to their normal outward position in secured engagement with the main module 402. In embodiments, the mounting legs 420 include locking detents 422 which grip the inside of the wall of the main module 402 while the flange 416 grips the outside of the wall thereby preventing release of the rebar support element 414 from the openings 412. FIG. 17 illustrates the main module 402 with the mounted rebar support elements 414 accommodating the rebar 1000. The rebar support element 414, which is formed of a resilient elastomeric material, accommodates any movement of the construction material, either natural or man-made (such as a seismic event or the like), or through settlement of the construction material, by virtue of its material of fabrication, i.e., the elastomeric material permits some shifting of the construction material through deformation of the elastomeric material. This significantly preserves the integrity of the rebar, construction material etc.

The anchor apparatus 400 may be utilized in a similar manner to the apparatus 300.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A construction anchor apparatus, which comprises:

a main module including opposed walls defining a longitudinal axis and having an internal chamber, the opposed walls each defining an elongated opening in communication with the internal chamber, a module mount associated with each of the opposed walls; and a rebar mount coupled to each module mount, the rebar mounts each defining an aperture therethrough to permit reception and passage of a length of rebar through the apertures and the elongated openings of the main module, each rebar mount configured for reciprocal longitudinal movement within the module mount to permit traversing movement of the length of rebar while the rebar mounts move within the module mount;

wherein the module mounts each includes a pair of longitudinal spaced rails disposed on an exterior surface of the opposed walls of the main module, each rail defining a groove for reception of an edge of the rebar mount.

2. The construction apparatus according to claim 1 wherein the elongated openings of the main module are configured to permit longitudinal traversing movement of the length of rebar while the rebar mounts move within the module mounts.

3. The construction apparatus according to claim 2 including a length of rebar extending through the elongated openings of the main module and the apertures of the rebar mounts.

4. The construction apparatus according to claim 2 including an end cap mountable to the main module to enclose the internal chamber.

5. The construction apparatus according to claim 4 wherein the end cap includes a pair of external rails and wherein the main module includes a pair of internal grooves for reception of the external rails to facilitate mounting of the end cap relative to the main module.

6. The construction apparatus according to claim 1 including a support assembly mountable relative to the main module and couplable to the length of rebar within the main module, the support assembly configured to support one of construction personnel or construction equipment.

7. The construction apparatus according to claim 6 wherein the support assembly includes a coupling member configured for coupling with the length of rebar within the main module and an elongate support member extending from the coupling member.

8. The construction apparatus according to claim 1 wherein the rebar mounts are configured for sliding movement within the module mounts.

9. A construction anchor apparatus, which comprises:

a main module including opposed walls defining a longitudinal axis and having an internal chamber, the opposed walls each defining an elongated opening in communication with the internal chamber, a module mount associated with each of the opposed walls;

a rebar mount coupled to each module mount, the rebar mounts each defining an aperture therethrough in alignment with the elongated openings in the opposed walls of the main module; and wherein the elongated openings of the main module and the apertures of the rebar mounts are configured to permit reception and passage of a length of rebar therethrough, the rebar mounts configured for reciprocal longitudinal movement relative to the module mounts to permit traversing longitudinal movement of the length of rebar within the internal chamber of the main module; wherein the module mounts each includes a pair of longitudinal spaced rails disposed on an exterior surface of the opposed walls of the main module, each rail defining a groove for reception of an edge of the rebar mount.

10. The construction apparatus according to claim 9 wherein the rebar mounts are slidably mounted to the module mounts.

11. The construction apparatus according to claim 10 including an end cap mountable to the main module to enclose the internal chamber.

12. The construction apparatus according to claim 11 wherein the end cap includes a pair of external rails and wherein the main module includes a pair of internal grooves for reception of the external rails to facilitate mounting of the end cap relative to the main module.

13. The construction apparatus according to claim 9 wherein the main module is configured to be embedded in a structural element.

14. The construction apparatus according to claim 9 wherein the main module includes a pair of opposed flanges depending outwardly therefrom, the flanges configured to facilitate securement of the main module relative to a structural element.

15. The construction apparatus according to claim 9 including a support assembly mountable relative to the main module and couplable to the length of rebar within the main module, the support assembly configured to support one of construction personnel or construction equipment.

16. The construction apparatus according to claim 15 wherein the support assembly includes a coupling member disposed within the main module and configured for coupling with the length of rebar.

17. The construction apparatus according to claim 16 wherein the coupling member is normally biased outwardly relative to the internal chamber of the main module.

18. The construction apparatus according to claim 16 wherein the support assembly includes an elongate support member extending from the coupling member.

* * * * *